United States Patent [19]

Bouque

[11] Patent Number: 4,869,524

[45] Date of Patent: Sep. 26, 1989

[54] MONOSKI BINDING

[75] Inventor: Jean M. Bouque, Annecy-le-Vieux, France

[73] Assignee: Salomon S.A., Annecy Cedex, France

[21] Appl. No.: 63,867

[22] Filed: Jun. 19, 1987

[30] Foreign Application Priority Data

Feb. 18, 1987 [FR] France ..... 87 2599

[51] Int. Cl.[4] ..... A63C 9/04

[52] U.S. Cl. ..... 280/617

[58] Field of Search ..... 280/607, 12 H, 611, 280/616, 617, 618, 633; 441/70

[56] References Cited

U.S. PATENT DOCUMENTS 3,802,714 4/1974 Freegard ..... 280/607
3,947,049 3/1976 Pederson ..... 280/607

FOREIGN PATENT DOCUMENTS 2222636 11/1973 Fed. Rep. of Germany .
2728009 1/1979 Fed. Rep. of Germany .
2494591 5/1982 France .
2536666 6/1984 France .

*Primary Examiner*—Charles A. Marmor
*Assistant Examiner*—Richard Camby
*Attorney, Agent, or Firm*—Sandler & Greenblum

[57] ABSTRACT

The present invention is directed to a safety binding which is adapted to be used with a monoski having a predetermined width, a predetermined length, and an upper surface. The safety binding comprises front and rear mounting means for releasably supporting two boots on the monoski. At least one continuous footrest plate is provided, preferably rearwardly of the front binding and adjacent thereto, which is positioned substantially transversely to the longitudinal central plane of the monoski. The footrest plate is provided to promote continuous motion of each of the boots towards the other of the boots when one of the boots is released from one of the bindings.

53 Claims, 8 Drawing Sheets

MONOSKI BINDING

BACKGROUND OF THE INVENTION

1. Field of the Invention

The present invention generally relates to a safety binding for use with a monoski which is adapted to maintain two boots thereon, and more specifically to a safety binding for a monoski which is adapted to free two boots from the monoski when a force is exerted which exceeds a predetermined release threshold.

2. Description of Background Materials and Relevant Information

Safety bindings are known and used in conventional skis which comprise two principle elements, i.e., a front binding which is adapted to maintain the front of the boots of the skier and a rear binding which is adapted to retain the rear of the boots of the skier. These front and rear bindings further comprise means for freeing the ends of a boot which they retain when the boot exerts a force on the binding which exceeds a predetermined threshold, i.e., a threshold known as the release threshold.

Generally, the front bindings ensure retention and liberation of the front end of a boot in the lateral direction, i.e., along a direction which is transverse to the longitudinal and vertical plane of symmetry of the monoski. The rear bindings include means for maintaining and freeing the boot in a substantially vertical direction.

Such front and rear bindings are most often equipped with a footrest wedge, positioned immediately adjacent thereto, on which a corresponding end of the boot sole will rest.

In this fashion, front bindings have positioned immediately behind them a footrest wedge which is adapted to raise the sole of the boot with respect to the upper surface of the ski. This wedge generally is provided with an upper surface which comprises an anti-friction material, e.g., polytetrafluorethylene, in a manner so as to facilitate lateral sliding of the boot when it biases the binding beyond the release threshold.

Such bindings for conventional skis have an obstruction along the level of their lower surface; this obstruction has a width which is substantially less than the width of a traditional ski. Similarly, conventional bindings are independent, i.e., they release independently from each other. In particular, it can occur that one boot is liberated from the set of bindings which retains it, while another boot is maintained by its set of bindings and thereby remains secure to the monoski.

Monoskis are most often equipped with such conventional bindings, although some have minor modifications.

Given that a monoski has a width which is equal to twice the width of a traditional ski, a spacing exists between the foot-rest wedges of two front bindings. As a result, a boot which is laterally freed towards the interior of the monoski, i.e., in the direction of the other front binding, is substantially likely to abut against the lateral edge of the footrest wedge of the other binding, thereby preventing total liberation of the otherwise free boot; or, at least, the existence of the wedges spaced from each other serves to retard movement of the free boot, thereby resulting in numerous accidents resulting from abutment of the boot with a side edge of one of the wedges.

Similarly, it can occur, as in traditional skiing, that one boot may be freed from the binding set which retains it, while the other boot remains attached to the ski because it does not move together with the first boot. Such an occurrence is extremely dangerous because the monoski has a weight and an inertia which are substantially greater than the weight and inertia of a conventional ski. Numerous accidents likewise occur as a result of this structure, and it is therefore important that both boots be set free virtually simultaneously to avoid such accidents.

SUMMARY OF THE INVENTION

Accordingly, the above and other objects, features and advantages of the present invention are provided for in a first aspect thereof by a safety binding for two ski boots which are adapted to be positioned on a monoski, said monoski having a predetermined length and width. The safety binding comprises means for retaining a front end of each of said boots along at least the exterior and the top of said monoski, and means for laterally releasing each of said boot front ends when excessive force is applied by one of said boots to a respective front binding. The safety binding further comprises means for retaining rear ends of the respective boots, which includes means for freeing the rear ends when excessive force is applied to said boots; and the safety binding further comprises a single, continuous footrest plate adapted to be positioned substantially transversely to the length of the monoski, and which is adapted to be attached to an upper surface of said monoski.

The footrest plate has a length which extends over substantially the entire width of said monoski and comprises a support zone for a sole of each of the boots which faces a respective front binding of the front boot end retaining means.

Two spaced support zones are adapted to be oppositely disposed from the front end retaining means, and the footrest plate has a thickness which progressively decreases from first and second opposed ends of said plate towards a central zone to thereby form a central recessed portion which is continuous with the support zones along the upper surface of said plate. The footrest plate comprises two abutting adjacent portions, and means for adjusting the spacing between the two portions and for maintaining respective upper surfaces of said portions in abutment in a continuous fashion with each other, over at least a portion of the width of the plate, as viewed in a longitudinal direction.

The footrest plate can have an upper surface which is convex along each of the support zones for boot soles. Each of the front bindings is provided with an individual footrest wedge, and the footrest plate has a central zone adapted to contact an upper surface of said monoski; the plate also has, along respective opposite sides of said central zone, lateral zones which each cover at least a portion of a respective footrest wedge associated with each of said front bindings.

The safety binding further comprises at least one central wedge movable along an upper surface of the plate in at least a transverse direction. This central wedge has a width which is substantially equal to the spacing between two boot soles when they are positioned on said monoski in a normal skiing position, wherein the front of each boot is maintained on the top surface and towards the exterior of said monoski by the front end retaining means, and towards the interior of the monoski by the central wedge, wherein said central wedge comprises means for transferring a force exerted by one of said boots towards the interior of the monoski to the other of said boots in order to force the other boot to the exterior of said monoski. The central wedge is mounted at a first, free end of an arm which is attached at a second end in a pivotable fashion to a substantially vertical axis on said monoski. The axis of the arm to said monoski is positioned forwardly of said central wedge, as viewed along the longitudinal direction of the monoski; alternately, the axis is positioned rearwardly of said central wedge, as viewed in the longitudinal direction of said monoski.

Elastic biasing means can be provided for forcing the central wedge into a central position along a longitudinal axis of the monoski after the arm has been moved away from its central position. The central wedge can have first and second convex lateral side edges. The central wedge may include two side plates and means for vertically adjusting the spacing between said side plates. These plates are attached, respectively, to upper and lower surfaces of a tongue extending generally longitudinally from the arm.

The central wedge may also comprise two wedge portions positioned adjacent to each other on opposite sides of a longitudinal, vertical plane of symmetry of the monoski, wherein each of the wedge portions includes a lateral support side comprising means for supporting a sole of a boot. Each portion of the central wedge is connected to the monoski by an arm pivoted about an axis secured to an upper surface of said monoski, and each portion comprises a contact surface which is substantially convex. Any of the safety bindings can be provided in combination with a monoski.

In another aspect, the present invention provides a safety binding which is adapted to be used with a monoski having a predetermined width, a predetermined length, and an upper surface. This safety binding comprises binding means for releasably supporting the front ends of two boots which are adapted to be positioned on said monoski; binding means for releasably supporting the rear portions of two boots which are adapted to be positioned on said monoski; and at least one footrest plate having a predetermined width and a predetermined length, wherein the plate is adapted to be positioned transversely to the longitudinal extent of the monoski in a position adjacent to the binding means for releasably supporting the front ends of the two boots.

The binding means for releasably supporting the front ends of two boots on said monoski can comprise two spaced apart front bindings, and the binding means for releasably supporting the rear portions of two boots on said monoski comprise two spaced apart rear bindings. Each of the front bindings comprises means for retaining the top of said boot on said monoski and retains said boot on said monoski at least along the exterior of said ski. Each of the front bindings comprises a pivotable body and a retention jaw, and each of the front bindings comprises means for limiting movement of each boot towards a central plane of said monoski. Each front binding can further comprise an elastic return member for biasing said boot into a normal skiing position when the boots are positioned on said monoski, and for returning the boots to a substantially straight position thereon. Each front binding is adapted to be symmetrically positioned about a central longitudinal plane of said monoski.

The plate is adapted to be positioned on an upper surface of said monoski, and comprises a unitary member. The plate can be adapted to be positioned rearwardly of the front bindings. It can, e.g., comprise two forwardly extending tongues spaced from each other and which are attached to respective front bindings, with the tongues extending forwardly from support zones on the plate member and towards said front bindings. The plate has an upper surface which comprises means for facilitating sliding of at least one boot sole thereon; the plate can include spaced support zones adjacent respective front bindings, and has a first thickness at each of said support zones. In one case, the plate further comprises a recessed central zone between the two support zones, with the central zone having a thickness less than the thickness of each of said support zones. The plate can taper downwardly from each said support zone towards said central zone in a substantially continuous fashion. Each of the support zones can have a substantially convex upper surface, or a substantially flat upper surface.

In one embodiment, only a central zone of the plate is adapted to contact said monoski; the plate further comprises support zones on either side of the central zone, with each of the support zones being spaced upwardly from said monoski upper surface.

The support zones can comprise flanges extending outwardly from said central zone, said flanges being adapted to rest on the upper surfaces of respective spaced footrest wedges which are located on the upper surface of a monoski to which said plate is adapted to be attached.

The plate can include a central zone and two lateral zones on opposite sides of said plate, with the central zone and the two lateral zones being adapted to contact the monoski when positioned thereon; in such a case, the plate has a front edge and a rear edge, with two spaced recesses extending from the front edge of said plate, which spaced recesses are adapted to receive two spaced footrest wedges located on the upper surface of a monoski.

The plate is a unitary member which is adapted to be positioned rearwardly of the boot front end binding means, with the binding further comprising spaced apart foot-rest wedges adapted to be positioned between the front end bindings and the plate. In this case the plate has a greater thickness than the thickness of either of said wedges.

Alternately, the plate comprises two members which are adjustably positioned with respect to each other transversely of a monoski on which they are adapted to be positioned.

Each member has a transversely extending tongue in slidable abutment with the other member, with each member having an upper surface, said upper surfaces being adapted to be at least partially continuous in all positions of said tongues.

Each member can further comprise a lower extension, said tongues and said lower extensions having thicknesses which are less than the thicknesses of the remaining portions of each member, each of said tongues being adapted to slide over a respective extension on the other member.

Each front end binding means comprises means for permitting interior motion of a boot held therein. The binding can further comprise at least one central wedge which is adapted to be positioned on the upper monoski surface and between said front end binding means, with the at least one central wedge having a maximum width which is substantially equal to the spacing between two boots positioned on the monoski during normal skiing. Each wedge is mounted on an arm pivotably mounted to the monoski about an axis located forwardly of said plate, and the wedge further comprises an elastic return mechanism in the form of a spring adapted to return each of the arms to a substantially longitudinal position on the monoski after the arms have been displaced from their longitudinal positions. Two identical wedges can be mounted directly adjacent to a central longitudinal plane of said monoski.

A wedge can be mounted on an arm pivotably mounted to said upper monoski surface about an axis located rearwardly of said plate, and can comprise two identical wedges mounted directly adjacent to a central longitudinal plane of the monoski. The central wedge can also include means for adjusting the height of the wedge, wherein the wedge includes lower and upper wedge sections adjustably attached to each other. Each section has a central bore, and a set screw is positioned in each bore which is adjustable and which thereby comprises means for adjusting the height of the central wedge.

The safety ski binding can be used in combination with a monoski.

In another aspect, the present invention provides a transverse footrest plate which is adapted to be positioned on the upper surface of a monoski. The footrest plate comprises a central zone having a predetermined thickness, said central zone having an upper surface and a bottom surface which is adapted to engage the upper surface of a monoski on which it is positioned, and two lateral zones, with one lateral zone being located on each side of the central zone. Each of the lateral zones has an upper surface which is continuous with the central zone upper surface, and a recessed area which comprises means for receiving a respective one of a plurality of spaced footrest wedges on the upper surface of the monoski.

Each lateral zone comprises a narrow plane extending outwardly from said central zone, and the plate can further comprise a downwardly extending leg located at each opposite side of the plate, with each of the legs having a lower surface adapted to contact said upper monoski surface. A plurality of apertures are provided which comprise means for receiving connecting elements for attaching said plate to said monoski.

BRIEF DESCRIPTION OF THE DRAWINGS

The above and other objects, features and advantages of the present invention will now be more fully described with reference to the annexed drawings, given by way of nonlimiting example only, in which like reference numerals represent similar parts throughout, and wherein.

DESCRIPTION OF PREFERRED EMBODIMENTS

One object of the present invention is to overcome all of the above-noted disadvantages and to provide a safety binding for use with a monoski in which one boot of a skier can be laterally free towards the interior of the monoski without abutting the free boot against the footrest of the other front binding.

Another object of the present invention is to provide a safety binding for a monoski which will promote the liberation of both boots, as soon as at least one of the boots is released from its binding, from the bindings which retain them.

Other objects and advantages of the present invention will become clear and apparent from the following description.

In accordance with the present invention, a safety binding is provided for two boots on a monoski which includes first forward retention means comprising front bindings which are adapted to retain the front of each boot along the top and towards the exterior edge of the monoski. The safety binding is also adapted to free the front of each boot, at least laterally, when extensive bias or force is exerted by one of the boots. The safety binding also comprises second retention means located at the rear end of the boot which retention means or bindings are adapted to retain the rear ends of the boots and to free these rear ends when excessive force is exerted on at least one of the boots.

The safety binding of the present invention can be characterized by the use of a single, transverse and continuous footrest plate located adjacent the front bindings, which is integrally attached to the upper surface of the monoski, and which has, located along a direction transverse to the monoski, a length which is substantially equal to the width of the monoski, and which further comprises a support zone for one boot sole facing each binding.

In accordance with another aspect of the present invention, the safety binding is provided with a central wedge which is movable along the upper surface of a single, transverse foot-rest plate, at least in a transverse direction, and which further has a width which is substantially equal to the spacing between two boot soles when the boots are placed in a normal skiing position on the monoski, such that the front of each of the boots on the monoski will be maintained along the top surface, and along the exterior surface, by a front binding which is adapted to retain it. It will also be retained towards the interior of the monoski by the central wedge, which transmits front forces from either of the boots towards the interior of the monoski.

Figure 1:
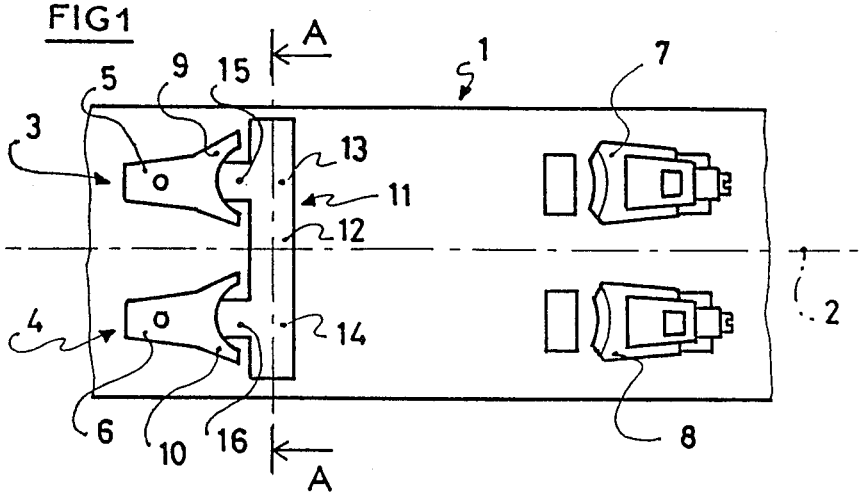
FIG. 1 is a partial schematic top view of a monoski having a central zone, illustrating one embodiment of the present invention.

FIG. 1 schematically illustrates a monoski 1 in a top, partial view with its central zone or longitudinal plane of symmetry illustrated by dashed lines 2. This plane of symmetry is both vertical and longitudinal. A set of bindings 3 and 4 are provided, with each binding in the set comprising a front binding 5, 6, respectively, and a rear binding 7, 8, respectively. Front bindings 5 and 6 can be provided in any appropriate configuration, and are easily adapted to retain the front of a respective boot at least vertically by retaining the top surface of the boot, and laterally to prevent it from moving to the exterior of the monoski. Front bindings 5 and 6 can similarly assure lateral retention of the boot to prevent it from moving towards the interior, or prevention of such movement can be maintained or ensured by an additional structure as described hereinafter.

Front bindings 5 and 6 are schematically shown in the form of bindings, each binding having a pivotable body with retention jaws 9 and 10 integrally attached to the bodies.

Front bindings 5 and 6 are similarly provided with elastic return means, which enable them to free the front of the boot which they retain when the boot exerts a bias against the elastic return means which exceeds a predetermined threshold, i.e., when it exceeds the release threshold.

Rear bindings 7 and 8 can similarly be constructed as any conventional type, and they are similarly adapted to retain and free the rear ends of the boots in a vertical direction, against the force or energy of an elastic return member.

According to the present invention, the safety binding includes, immediately to the rear of retention jaws 9 and 10 of the front end of the boots, a footrest plate 11 which comprises a single plate having an upper surface 12 which extends in a substantially continuous manner over substantially the entire width of the monoski, as seen in FIG. 1.

Footrest plate 11 is integrally attached to the upper surface of the monoski by any appropriate fastening member, e.g., by screws (not shown).

Figure 2:
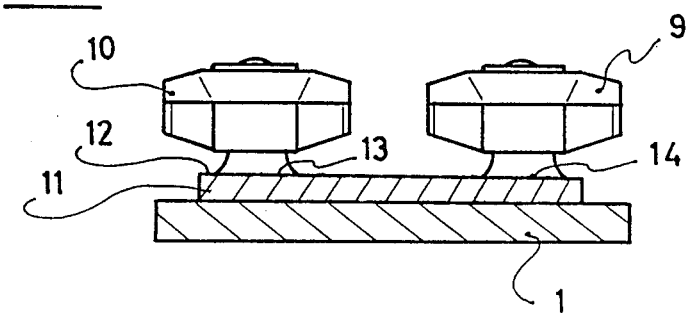
FIG. 2 is a cross-sectional view taken along line A—A of FIG. 1.

FIGS. 1 and 2 illustrate a footrest plate 11 in the form of a uniform monoblock assembly having a length, in a direction transverse to the monoski, which is substantially less than the width of the monoski. In the longitudinal direction, the foot-rest plate has any appropriate direction, e.g., it can have a length approximating the length of a conventional footrest wedge. In this longitudinal direction, upper surface 12 of footrest plate 11 can take on any appropriate shape, and specifically can have either a flat, rounded, convex or any another configuration which is desired.

Similarly, upper surface 12 of the footrest plate 11 can be provided with any appropriate member which will facilitate the lateral sliding motion of the sole of the boot, and, e.g., as is well known, a layer of polytetrafluorethylene, a mechanical sliding member such as a roller or a rotating disk, all of these being well known to those of skill in the art.

If desired, tongues 15 and 16, respectively, could be provided so as to ensure the linkage or attachment of the front portion of the front bindings 5 and 6, respectively, to the monoski, i.e., a pivot in the case of the bindings illustrated in FIG. 1.

Upper surface 12 of footrest plate 11 further comprises support zones 13 and 14 which face jaws 9 and 10 on front bindings 5 and 6, respectively, and upon which the front portion of a boot sole will be positioned.

Figure 3:
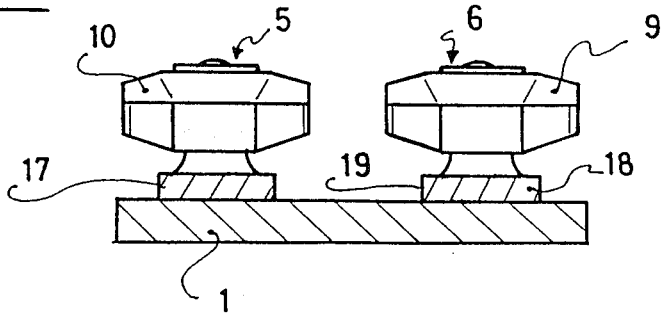
FIG 3 PRIOR ART
FIG. 3 is a sectional view similar to that of FIG. 2 illustrating a prior art structure.

FIG. 3 illustrates a prior art device in which each front binding 5 and 6 is provided with an individual footrest wedge 17 and 18, respectively. With such construction, it happens that one of the boots, when laterally freed by its bindings, e.g., when binding 5 frees one of the boots, will be abutted against the interior edge 19 of the other foot-rest wedge 18, thus hindering lateral sliding motion of the boot away from the ski.

Referring now to FIG. 2, it is apparent that such blockage will not occur when using a single footrest plate 11, which is the only plate on the monoski adjacent the front bindings, and which extends over substantially the entire width of the monoski. In essence, a boot could slide in a continuous manner towards the interior of the monoski until it is completely freed from its respective binding.

Figure 4:
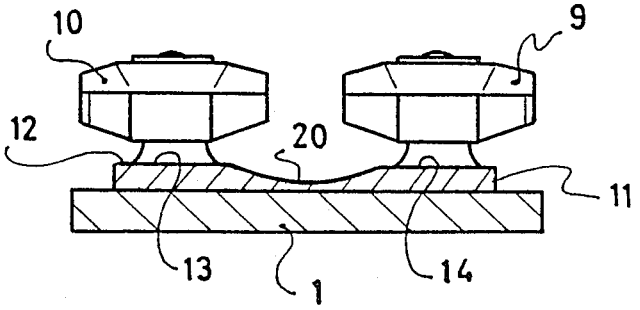
FIGS. 4, 5 and 6 illustrate second, third, and fourth embodiments of the present invention, each of these FIGS. being a sectional view similar to the sectional view of FIG. 2.

FIG. 4 illustrates another embodiment of the present invention in which the upper surface 12 of the footrest plate 11, adjacent both support zones 13 and 14, descends in a progressive fashion, then rises in a similar progressive fashion. This results in the existence, between the two support zones 13 and 14, of a progressive hollowed or recessed space or area, without creating a sudden discontinuity in the upper surface 12 of the footrest plate.

Such an arrangement is preferable to the prior art, because it provides the boot with more vertical freedom during the course of its lateral release from its associated binding, but still enables it to slide relatively freely over the entire transverse extent of the plate.

Figure 5:
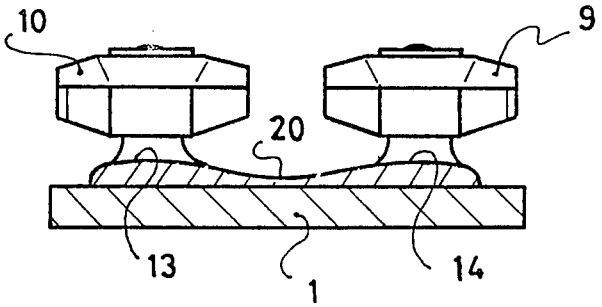

FIG. 5 illustrates another embodiment of the present invention in which support zones 13 and 14 are themselves curved, in the transverse direction, in a convex fashion; these zones are connected along the interior of the monoski by a recessed space or zone 20. However, it is apparent that the upper surface 12 of the footrest plate 11 remains continuous, in the transverse direction, i.e., it does not have a sudden edge, except if desired at each of its lateral ends adjacent the exterior edges of the monoski (see FIG. 6, e.g.)

Figure 6:
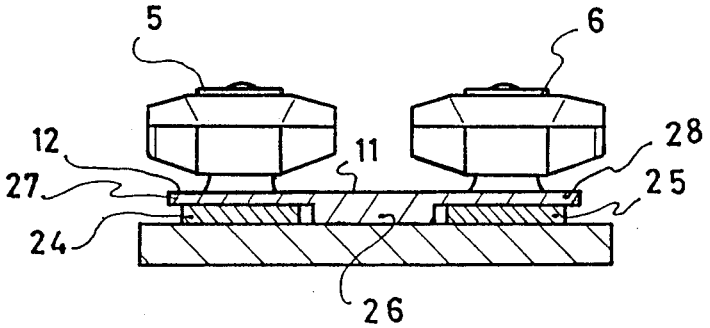

FIG. 6 well illustrates another alternative embodiment of the invention in which foot-rest plate 11 is positioned in a complimentary fashion with respect to two individual foot-rest wedges 24 and 25, which are each associated with a respective front binding 5, 6. These individual foot-rest wedges 24 and 25 are, e.g., conventional spaced apart wedges which are associated with respective front bindings.

In this case, the single footrest plate 11, which is transverse and continuous, has a central, relatively thick zone 26, which contacts the upper surface of the monoski between the two individual foot-rest wedges 24 and 25. On each side of central zone 26, footrest plate 11 includes lateral zones or outwardly extending flanges 27 and 28 which cover, at least partially, each of the individual foot-rest wedges 24 and 25. Upper surface 12 of the footrest plate 11, as in the preceding instances, is continuous over substantially the entire width of the monoski.

It should be noted that with such a construction, the surface which supports the front of each boot is substantially higher than that which occurs with conventional foot-rest wedges. However, such a construction is preferred because it makes it possible to use the invention for monoskis which already include conventional bindings, regardless of the spacing between the two front bindings 5 and 6. In other words, the plate 11 is simply positioned over the existing spaced wedges, fastened to the monoski, and can then be easily used.

Similarly, when individual footrest wedges 24 and 25 comprise pedals which are vertically movable downwardly towards the top surface of the monoski, and which thereby transmit a vertical bias downwardly to the energizing means of the front binding, the embodiment of FIG. 6 advantageously makes it possible to maintain this compensation mechanism in an operable fashion; in effect, each lateral zone 27 and 28 is adapted to flex towards the top of the monoski in response to a bias applied to the bottom of the boot, and therefore each zone or flange is capable of activating the pedal of a compensation mechanism downwardly.

Figure 7:
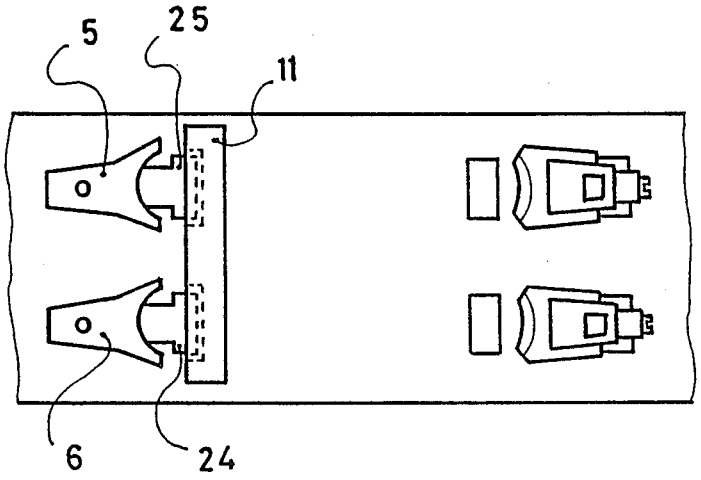
FIG. 7 is a top schematic plan view of a fifth embodiment of the present invention.
Figure 8:
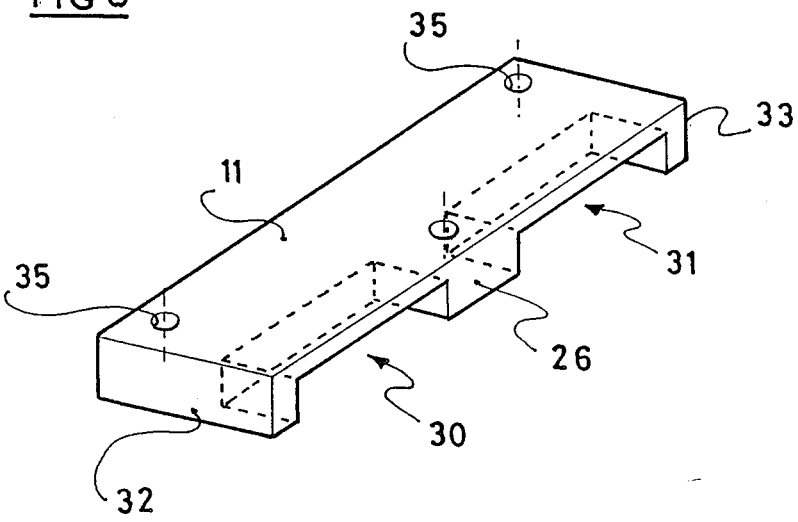
FIG. 8 is a perspective view of a block used in the embodiment of FIG. 7.

FIGS. 7 and 8 illustrate another embodiment of the foot-rest plate illustrated in FIG. 6. According to this embodiment, the foot-rest plate 11 includes, on each side of central zone 26, openings 30 and 31, respectively, in which conventional foot-rest wedges 24 and 25 are positioned and which are already in place on the monoski. The width and positioning of openings 30 and 31 are selected so that the footrest plate 11 can be incorporated onto conventional monoskis, regardless of the spacing between front bindings 5 and 6.

Each opening 30, 31 is limited along its exterior by an end zone or leg 32, 33, respectively, of footrest plate 11, which end zones drop or taper downwardly in the direction of the upper surface of the monoski. Together with central portion 26, the legs serve to support the block on the upper surface of the monoski.

FIG. 8 similarly illustrates orifices 35 for inserting attachments to the plate 11 to attach the plate to the monoski.

Figure 9:
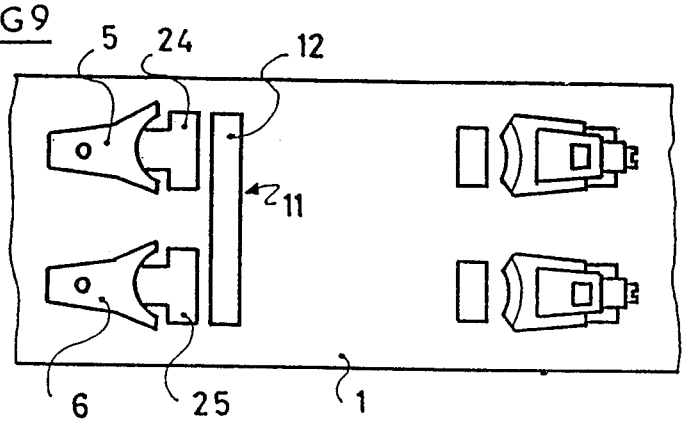
FIG. 9 is a top plan view of a sixth embodiment of the present invention.

FIG. 9 illustrates another embodiment of the invention in which a single, transverse footrest plate 11 is integrally formed with the upper surface of the monoski behind previously positioned and existing foot-rest plate wedges. As a result, footrest plate 11 and footrest wedges 24 and 25 are independent of each other.

In the embodiments of FIGS. 6–9, in which the foot-rest plate 11 complements the conventional spaced foot-rest wedges, upper surface 12 of foot-rest plate 11 is located at a higher level than the upper surfaces of the individual foot-rest wedges 24 and 25, at least in the area of support zones 13 and 14 of each of the boots; in this manner, each of the boots will slide laterally towards the interior of the ski and will no longer be supported on the individual foot-rest wedges, but will instead be supported on the continuous footrest plate 11.

Figure 10:
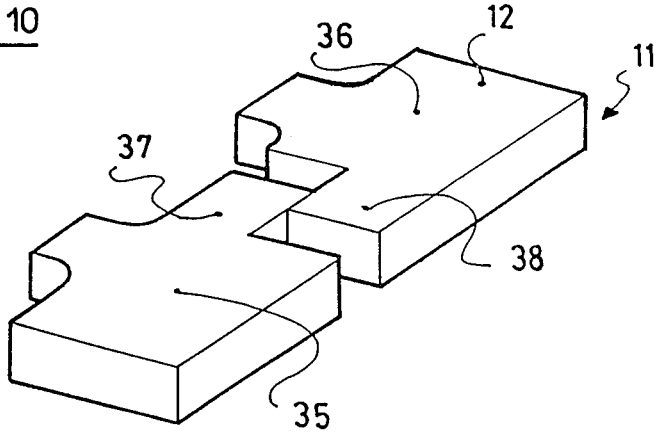
FIG. 10 is a perspective view of a footrest plate formed in accordance with a seventh embodiment of the present invention.
Figure 11:
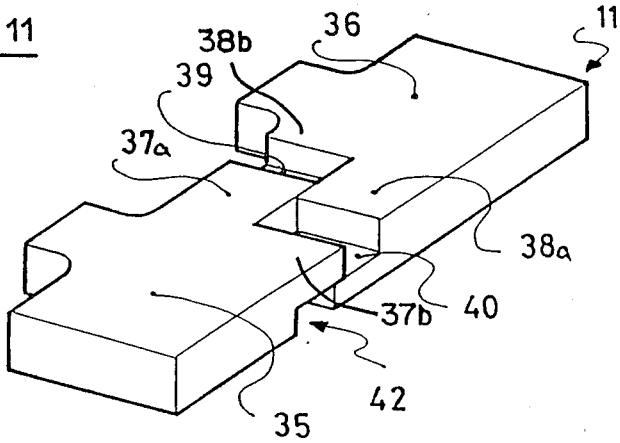
FIG. 11 is a perspective view of a footrest plate similar to that of FIG. 10.

FIGS. 10 and 11 illustrate two alternate embodiments of foot-rest plate 12, in which the foot-rest plate comprises two portions 35 and 36 having adjustable spacing in a fashion so as to adapt the footrest wedge to the particular spacing between any two front bindings 5 and 6. However, upper surface 12 of foot-rest plate 11 remains continuous, over at least a portion of its width, as measured in the longitudinal direction of the monoski.

FIG. 10 illustrates two footrest portions 35 and 36, each of which extends towards the interior of the monoski via a respective tongue 37, 38. Tongues 37 and 38 are arranged in the longitudinal direction, and are adapted to slide over each other in a transverse direction with respect to the central plane of the ski. Thus, continuity of the upper surface 12 of foot-rest plate 11 is ensured by virtue of the overlap of the central zone formed by the areas around tongues 37 and 38.

FIG. 11 illustrates a substantially different embodiment of the invention in which tongues 37 *a, b* and 38 *a, b* have, along their lower portions, extensions 39 and 40, respectively; these extensions engage the underside of tongues on the opposite member in order to form a complementary opening in the foot-rest plate. In FIG. 11, only a single opening 42 is visible adjacent to extension 40.

FIGS. 12 through 21 relate to yet another embodiment of the invention, in which front bindings 5 and 6 ensure that the front of the boot will be retained along the top and exterior portions of the monoski; the front of each of the boots is adapted to be freed laterally, towards the exterior of the binding.

Towards the interior of the monoski, at least one central wedge is provided in the embodiments of these figures, which wedge(s) is adapted to transmit to the non-moving boot the forces which the front of the moving boot generate during the course of skiing. Such a construction is preferred because it promotes the simultaneous liberation of the two boots from the binding whenever one of the boots exerts on the binding a force greater than that which retains it, i.e., which is released because the force exerted is greater than the release threshold of the binding.

Figure 12:
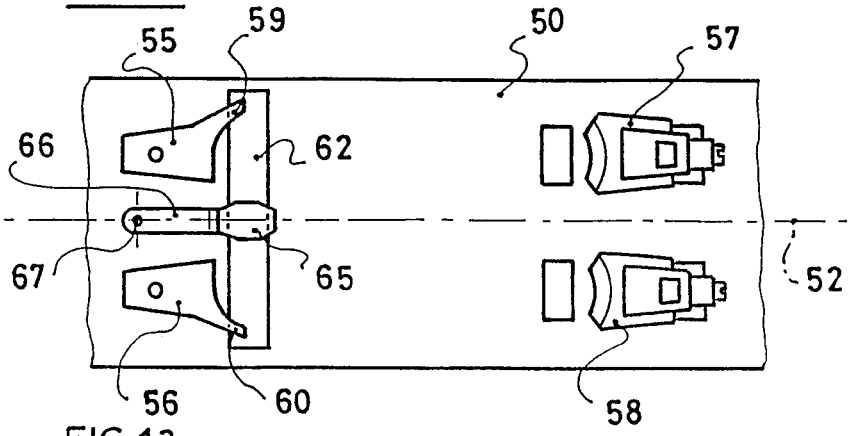
FIG. 12 is a top schematic plan view of a monoski and binding illustrating an eighth embodiment of the present invention.

Thus, FIG. 12 illustrates a monoski 50 having two binding assemblies located along each side of the vertical and longitudinal plane of symmetry, shown in dotted lines at 52. Each assembly comprises a front binding 55, 56, respectively, and rear bindings 57, 58, respectively.

Front bindings 55 and 56 are adapted to retain the front of the respective boots along the top of the boot and exterior portion of the boot, and to free the boot laterally towards the exterior of the monoski. Jaws 59 and 60 of front bindings 55 and 56, respectively, have been illustrated with only one exterior retention wing, thus permitting movement of the boot front end towards the horizontal plane of the monoski.

The safety binding further includes, located behind front bindings 5 and 6, a single, continuous transversely positioned foot-rest plate 62 which is particularly similar to the foot-rest plate 12 described previously. The important feature of this invention is that it again includes an upper surface which is substantially continuous over almost the entire width of the monoski.

The binding of FIG. 12 further comprises a central wedge 65 which is located at the level of the front end of the soles of the boots, and which has a maximum width which is substantially equal to the spacing between the two boot soles when they are placed in a normal skiing position; the wedge is movable along the upper surface of the monoski, at least in a transverse direction.

Central wedge 65 further has a height which is, at most, equal to the thickness of the sole of the boot, as measured between the lower surface of the sole and the upper border of the sole.

FIGS. 12–15 illustrate one embodiment of this type of binding which includes a central wedge 65 which is mounted on the rear end of an arm 66, which arm is itself pivotally mounted around an axis 67 which is integrally attached to the monoski. Naturally, axis 67, which is situated along the longitudinal and vertical plane of symmetry of the monoski, is positioned in such a manner that arm 66 can laterally pivot without abutting front bindings 55 and 56, over an angle which is sufficient to permit the total liberation of the boots from their bindings, as described hereinafter.

Figure 15:
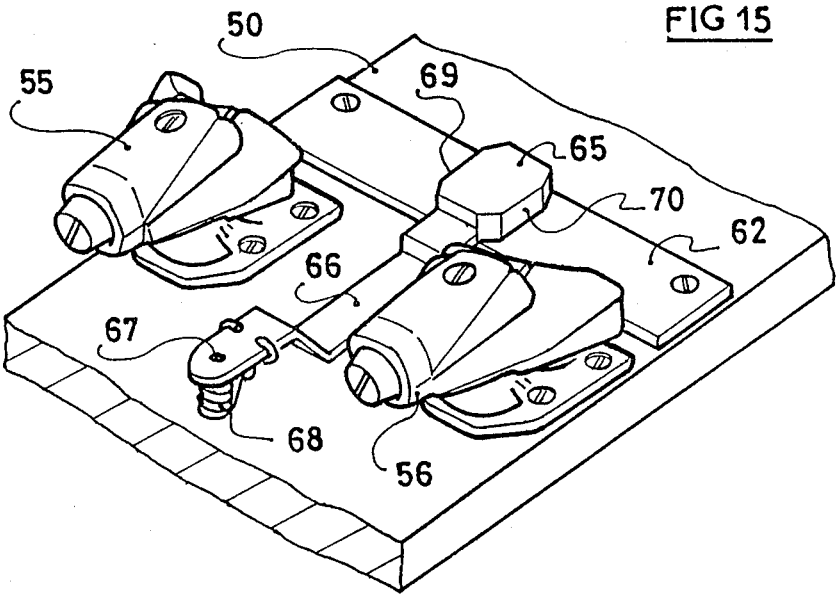
FIG. 15 is a cutaway perspective view of the apparatus of FIG. 12, illustrating the front binding and central wedge thereof.

Further (and preferably), the central wedge 65 is adapted to be returned to its central position by an elastic return mechanism, whenever it has been displaced. In FIG. 15, the return mechanism is schematically shown in the form of a torsion spiral spring 68 which is mounted to the monoski on journal axis 67 of arm 66. Naturally, any other guiding means for wedge 65 will be appropriate, as long as such guiding means will at least ensure the displacement of wedge 65 along a transverse direction. Similarly, any elastic return member for returning wedge 65 to its center position can be used.

Laterally, central wedge 65 includes sides 69 and 70 against which the interior edge of each of the boot soles will be supported. The sides are substantially vertical, and are substantially parallel if viewed from above; as shown in these FIGS., the sides are substantially parallel along a central zone and converge towards each other along the front and rear portions thereof. Any other suitable configuration can be used, e.g., a convex configuration could be provided for each wedge 65.

Figure 13:
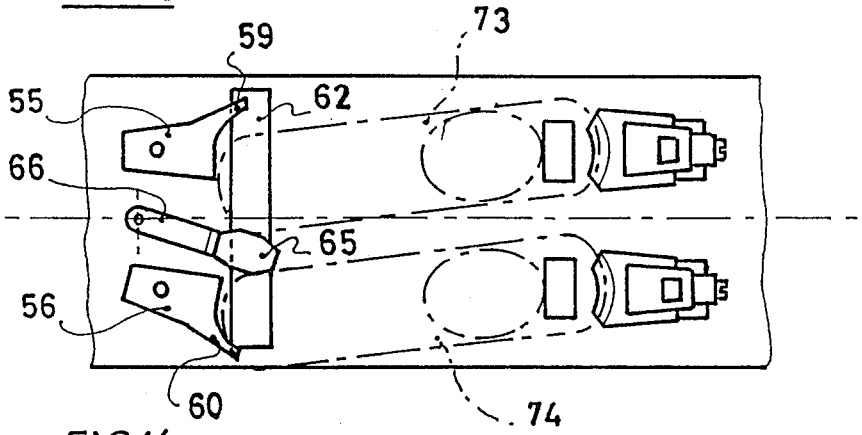
FIG. 13 illustrates one method of operation of the monoski and bindings of FIG. 12.
Figure 14:
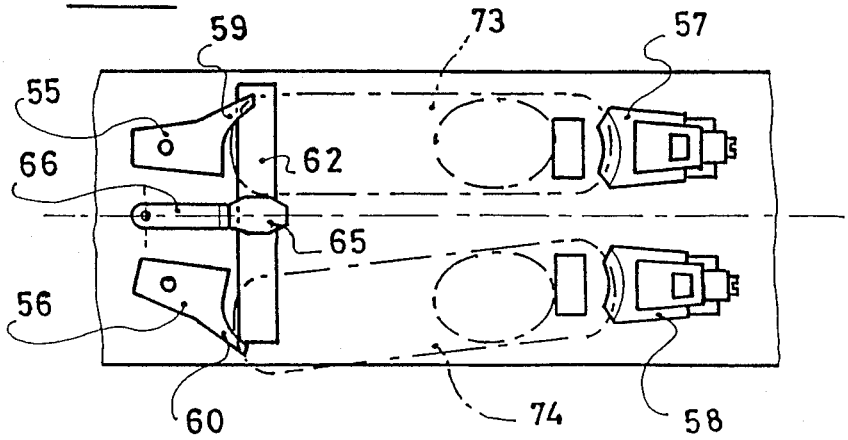
FIG. 14 is a top plan view illustrating another operational position of the monoski and bindings of FIG. 12.

FIGS. 13 and 14 illustrate the operation of the safety binding of the present invention, and show two boots 73 and 74 schematically in dashed lines.

In FIG. 13, two boots 73 and 74 are shown which are attempting to be freed laterally, along the outside of boot 74. For example, as a result of the torsional force which is exerted simultaneously by two legs of a skier.

In such an arrangement, boot 74 laterally biases jaw 60 of the front binding 56 which retains the boot. Similarly, the front of boot 73 exerts on central wedge 65 a central bias towards the interior of the ski, which is transferred to the front of boot 74 by the same central wedge 65.

In this fashion, jaw 60 of front binding 56 will be subjected to the exterior bias of the front of boot 74, to which is added the interior bias of the front of boot 73. Assuming that the release threshold of binding 56 is attained, the two boots will move laterally by sliding on foot-rest plate 61, as shown in FIG. 13. Central wedge 65 accompanies this central sliding motion of the two boot fronts 73 and 74 until total liberation of the two boots has occurred. This liberation occurs when the front of boot 74 is freed from jaw 60 of front binding 56, which pivots about its axis, and when the front of boot 73 escapes from jaw 59 of front binding 55, which has not itself pivoted.

In order to pivot laterally, interior boot 73 must overcome the return energy of arm 66 from its center position. This energy, however, is less than the return energy of the front binding. However, preferably, the energy is sufficient so as to maintain only one of the boots in position within its front binding, and to thus allow for the displacement of boots from the monoski by a combined sliding and walking motion. Such an arrangement is preferred when skiers are in lift wait lines.

In FIG. 14, it is assumed that boot 74 has exerted a force on its front binding 56 towards the exterior of the ski, beyond its release threshold, and that boot 73 will remain in position.

As a result, central wedge 65 will not move. However, after boot 73 laterally slides towards the exterior of boot 74, it will no longer be maintained towards the interior except by central wedge 65. As a result, it is only necessary to overcome the return energy of the wedge in order to escape the front binding which retains it. Liberation of boot 73 will therefore be easier than if the boot had to otherwise overcome the return energy of a conventional front binding.

When liberation of either of boots 73 and 74 occurs as a result of the boots being released by the rear bindings 57 or 58, central wedge 65 will similarly favor simultaneous exit of the two boots from their bindings. In effect, if a force is exerted by the two boots which exceeds the release threshold of their respective rear bindings, both of the boots will be liberated. To the contrary, if only the force of one of the boots reaches the release threshold, and the other boot, e.g., boot 73, remains retained by its rear binding, a configuration similar to that described with respect to FIG. 14 again appears. In effect, boot 73 will no longer be maintained at the level of its front end except by central wedge 65, and it can be liberated more easily than if it were being retained by a conventional front binding.

Figure 16:
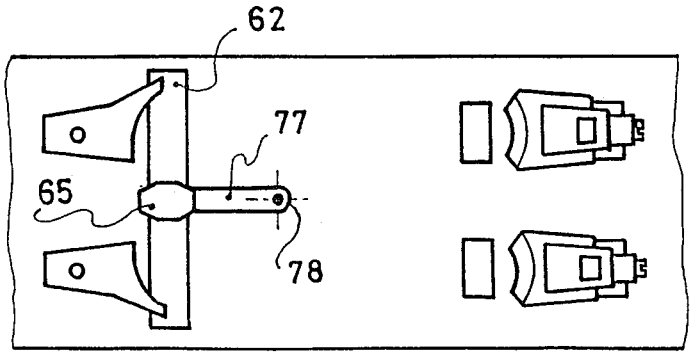
FIG. 16 is a top plan view of an alternate embodiment of the apparatus of FIG. 12.

FIG. 16 illustrates yet another alternative embodiment of the binding in which central wedge 65 is connected to the monoski by an arm 77 which is oriented, no longer frontwardly, but instead rearwardly. In this fashion, arm 77 is journalled about an axis 78 which is integrally attached to the monoski, which axis is located rearwardly behind foot-rest plate 62.

Figure 17:
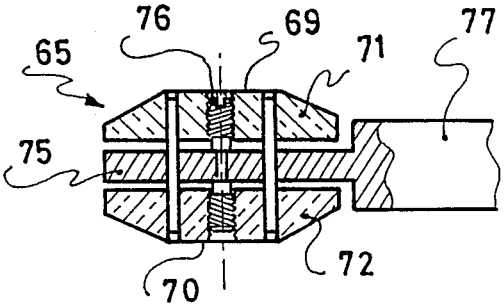
FIG. 17 is a sectional view of an alternate embodiment of the central wedge used in the embodiments of FIGS. 12–16.

FIG. 17 illustrates another alternative embodiment of central wedge 65 in which the wedge includes two lateral side plates 71 and 72 having an adjustable relative spacing. These side plates 71 and 72 each comprise side edges 69 and 70 along which the boots are adapted to be supported. Further, FIG. 17 illustrates a spacing adjustment mechanism, in the form of one or more screws 76 having reverse threads, which mechanism is maintained along the center of the wedge plates at the level of a central portion 75 which is integrally connected with arm 77. By using such an arrangement, the height of the wedge can easily be adjusted e.g. to accommodate boots with soles of various thicknesses.

FIGS. 18–21 relate to another embodiment of the invention, in which central wedge 65 is provided in two halves 80 and 81, which wedge halves are symmetrically positioned with respect to the longitudinal and vertical planes of symmetry of the monoski, and which, in the normal skiing position of a skier, are juxtaposed along this plane.

Each of portions 80 and 81 includes its own displacement means, as viewed along a transverse direction with respect to the monoski. These means comprise, e.g., arms 82 and 83, which are respectively pivotable with respect to an axis which is integral with the monoski. The two axes of rotation of arms 82 and 83 are both symmetrically located with respect to the longitudinal and vertical planes of symmetry of the monoski, and there is a space located between them.

Figure 18:
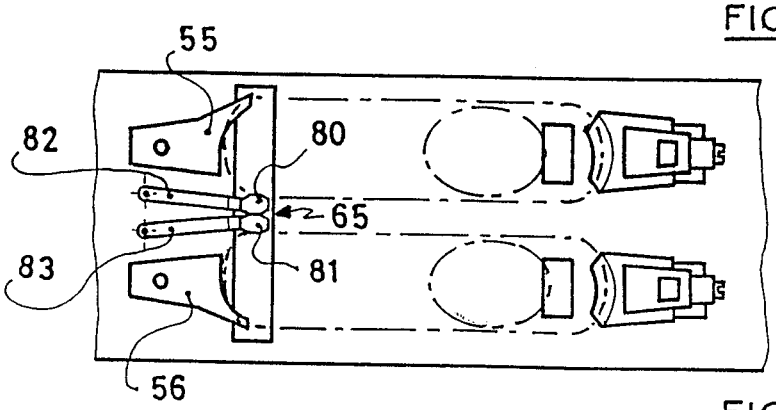
FIG. 18 is a top plan view of a ninth embodiment of the monoski and binding of the present invention.
Figure 19:
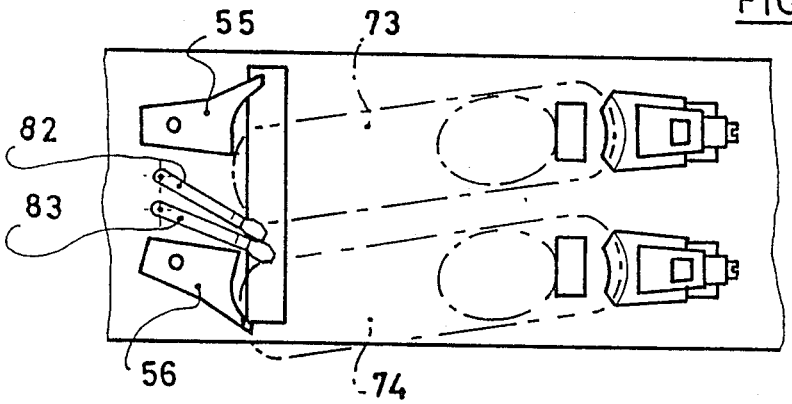
FIG. 19 illustrates one position of the apparatus of FIG. 18 in operation.
Figure 20:
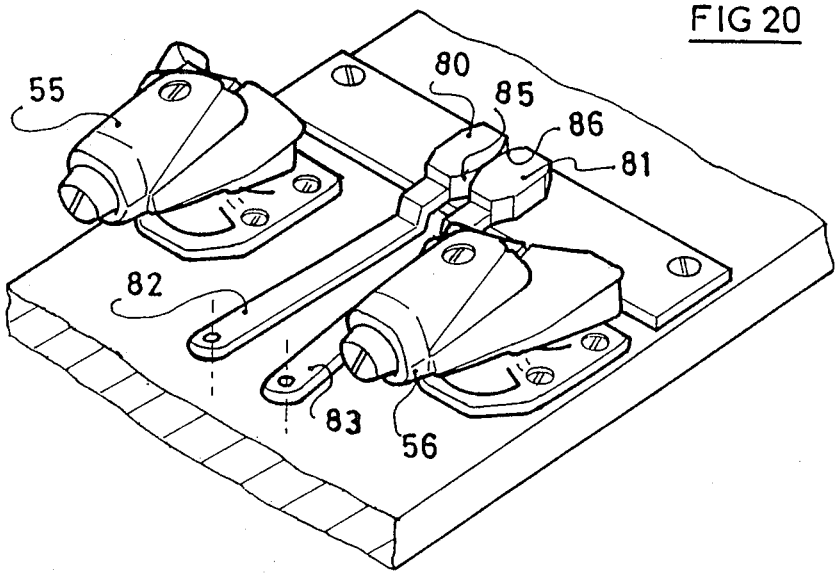
FIG. 20 is a perspective cutaway view of the apparatus of FIG. 18, illustrating the front bindings thereof.

FIGS. 18–20 illustrate the arms as being oriented towards the front of the monoski, with their respective journal axis to the monoski being situated between the two front bindings 55 and 56 and forwardly of the transverse plate.

Each portion 80, 81 of central wedge 65 includes, towards its exterior, a lateral side which is similar to wedge sides 69 and 70 described above. Towards the interior of the monoski, each portion of central wedge 80 and 81 includes a contact surface in the form of convex camming surfaces 85, 86. FIG. 19 illustrates the operation of the embodiment of FIG. 18. In this embodiment, it can be seen that a configuration is provided which is similar to that described in FIG. 13. Specifically, wedge portion 80, located along the interior side of boot 73, engages portion 81 via the convexly cam shaped portions 85 and 86 of the contact surfaces and the spacing between the respective rotation axes of arms 82 and 83.

As a result, the interior boot of 73 will preferably pivot towards the interior of the ski, which will accelerate liberation of this boot from its associated binding.

Figure 21:
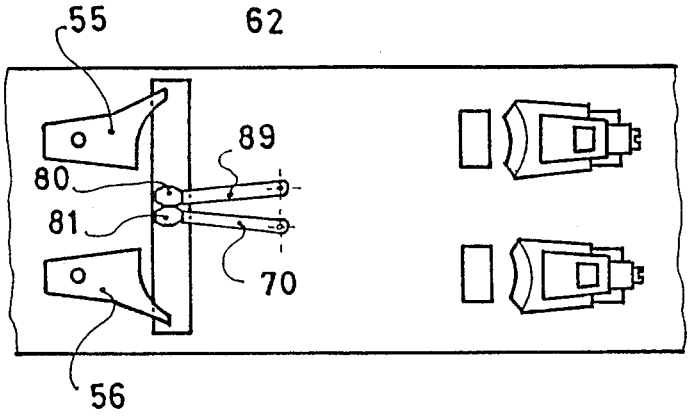
FIG. 21 is another alternative binding embodiment similar to the apparatus of FIGS. 18–20.

FIG. 21 illustrates yet another embodiment of the present invention in which portions 80 and 81 of central wedge 65 are connected to the monoski by arms 89 and 90, respectively, which are oriented, not towards the front, but instead towards the rear of the ski. As a result, the journal axes of each pf the wedge portions to the monoski is located behind footrest plate 62.

Naturally, although the present invention has been described with respect to particular means, materials and embodiments thereof, it is to be understood that the invention is not limited to the particular features described and disclosed herein, but instead extends to all equivalents within the scope of the claims.

What is claimed is:

1. A safety binding for two ski boots which are adapted to be positioned on a monoski, said monoski having a predetermined length and width, said safety binding comprising means for retaining a front end of each of said boots along at least the outside and the top of said monoski, means for laterally releasing each of said boot front ends when excessive force is applied by one of said boots to said retaining means, and means for retaining the rear ends of said respective boots which includes means for freeing said rear ends when excessive force is applied to said boots said safety binding further comprising a single, continuous footrest plate comprising an antifriction material and adapted to be positioned substantially transversely to said length of said monoski and beneath each of said boot front ends and adapted to be attached to an upper surface of said monoski.

2. A safety binding in accordance with claim 1, wherein said footrest plate has a length which extends over substantially the entire width of said monoski, said plate further comprising a support zone for a sole of each of said boots adjacent said front end retaining means.

3. A safety binding in accordance with claim 2, wherein there are two spaced support zones adapted to be oppositely disposed from said front end retaining means, and wherein said footrest plate has a thickness which progressively decreases from first and second opposed ends of said plate towards a central zone to thereby form a central recessed portion which is continuous with said support zones along the upper surface of said plate.

4. A safety binding in accordance with claim 2, wherein said footrest plate comprises two abutting adjacent portions, said plate comprising means for adjusting the spacing between said two portions and for maintaining respective upper surfaces of said portions in abutment in a continuous fashion with each other, over at least a portion of the width of said plate, as viewed in a longitudinal direction.

5. A safety binding in accordance with claim 2, wherein said footrest plate has an upper surface which is convex along each of said support zones.

6. A safety binding in accordance with claim 2, wherein said front end retaining means comprises two front bindings, each of said front bindings being provided with an individual footrest wedge, said footrest plate having a central zone adapted to contact an upper surface of said monoski, .said footrest plate having, along respective opposite sides of said central zone, lateral zones which each cover at least a portion of a respective foot-rest wedge associated with each of said front bindings.

7. A safety binding for two ski boots which are adapted to be positioned on a monoski said monoski having a predetermined length and width said safety binding comprising means for retaining a front end of each of said boots along at least the outside and the top of said monoski, means for laterally releasing each of said boot front ends when excessive force is applied by one of said boots to said retaining means and means for retaining the rear ends of said respective boots which includes means for freeing said rear ends when excessive force is applied to said boots, said safety binding further comprising a single continuous footrest plate adapted to be positioned substantially transversely to said length of said monoski and beneath each of said boot front ends and adapted to be attached to an upper surface of said monoski, wherein said footrest plate has a length which extends over substantially the entire width of said monoski said plate further comprising a support zone for a sole of each of said boots adjacent said front end retaining means said safety binding further comprising at least one central wedge movable along an upper surface of said plate in at least a transverse direction , said central wedge having a width which is substantially equal to the spacing between two boots soles when two boots are positioned on said monoski in a normal skiing position, wherein the front of each boot is maintained on the top surface and towards the exterior of said monoski by said front end retaining means, and towards the interior of said monoski by said central wedge, wherein said central wedge comprises means for transferring a force exerted by one of said boots towards the interior of said monoski to the other of said boots to force said other boot to the exterior of said monoski.

8. A safety binding in accordance with claim 7, wherein said central wedge is mounted at a first, free end of an arm which is attached at a second end in a pivotable fashion to a substantially vertical axis on said monoski.

9. A safety binding in accordance with claim 8, wherein the axis of said arm to said monoski is positioned forwardly of said central wedge, as viewed along the longitudinal direction of said monoski.

10. A safety binding in accordance with claim 8, wherein said axis is positioned rearwardly of said central wedge, as viewed along the longitudinal direction of said monoski.

11. A safety binding in accordance with claim 7, further comprising elastic biasing means for forcing said central wedge into a central position along a longitudinal axis of said monoski after said arm has been moved away from said central position.

12. A safety binding in accordance with claim 8, wherein said central wedge has first and second convex lateral side edges.

13. A safety binding in accordance with claim 8, wherein said central wedge includes two plates and means for vertically adjusting the spacing between said plates, wherein said plates are attached, respectively, to upper and lower surfaces of a tongue extending generally longitudinally from said arm.

14. A safety binding in accordance with claim 8, wherein said central wedge comprises two wedge portions positioned adjacent to each other on opposite sides of a longitudinal, vertical plane of symmetry of said monoski, wherein each of said wedge portions includes a lateral support side comprising means for supporting a sole of said boot.

15. A safety binding in accordance with claim 14, wherein each portion of said central wedge is connected to said monoski by an arm pivoted about an axis secured to an upper surface of said monoski.

16. A safety binding in accordance with claim 14, wherein each portion of said central wedge comprises a contact surface which is substantially convex.

17. A safety binding for two ski boots which are adapted to be positioned on a monoski said monoski having a predetermined length and width , said safety binding comprising means for retaining a front end of each of said boots along at least the outside and the top of said monoski means for laterally releasing each of said boot front ends when excessive force is applied by one of said boots to said retaining means , and means for retaining the rear ends of said respective boots which includes means for freeing said rear ends when excessive force is applied to said boots said safety binding further comprising a single continuous footrest plate comprising an antifriction material and adapted to be positioned substantially transversely to said length of said monoski and beneath each of said boot front ends and adapted to be attached to an upper surface of said monoski, wherein said safety binding is in combination with a monoski.

18. A safety binding which is adapted to be used with a monoski having a predetermined width, a predetermined length, an upper surface, said safety binding comprising:

(a) binding means for releasably supporting the front ends of two boots which are adapted to be positioned on said monoski;

(b) binding means for releasably supporting the rear portions of two boots which are adapted to be positioned on said monoski; and (c) at least one footrest plate having a predetermined width and a predetermined length, wherein said plate is adapted to be positioned transversely to the longitudinal extent of said monoski in a position adjacent to said binding means for releasably supporting said boot front ends.

(d) means for transferring a force of a first magnitude to said two boots for laterally supporting said two boots concurrently and for transferring a force of a second lesser magnitude to either of said two boots for laterally supporting one of said two boots after the front end of the other of said two boots has shifted away form said force transferring means.

19. A safety binding in accordance with claim 18, wherein said binding means for releasably supporting the boot front ends on said monoski comprise two spaced apart front bindings.

20. A safety binding in accordance with claim 19, wherein said binding means for releasably supporting the rear portions of two boots on said monoski comprise two spaced apart rear bindings.

21. A safety binding in accordance with claim 19, wherein each of said front bindings comprises means for retaining the top of a boot on said monoski and which retains said boot on said monoski at least along the exterior of said ski.

22. A safety binding in accordance with claim 21, wherein each of said front bindings comprises a pivotable body and a retention jaw.

23. A safety binding in accordance- with claim 22, wherein each of said front bindings further comprises means for limiting movement of each boot towards a central plane of said monoski.

24. A safety binding in accordance with claim 21, wherein each front binding comprises an elastic return member for biasing said boot into a normal skiing position when said boots are positioned on said monoski and for returning said bindings to a substantially straight position on said monoski.

25. A safety binding in accordance with claim 19, wherein each front binding is adapted to be symmetrically positioned about a central longitudinal plane of said monoski.

26. A safety binding in accordance with claim 19, wherein said plate is adapted to be positioned on an upper surface of said monoski.

27. A safety binding in accordance with claim 26, wherein said plate comprises a unitary member.

28. A safety binding in accordance with claim 27, wherein said plate is adapted to be positioned rearwardly of said front bindings., 29. A safety binding in accordance with claim 28, wherein said plate further comprises two forwardly extending tongues spaced from each other and being attached to respective front bindings, said tongues extending forwardly from support zones on said plate member and towards said front bindings.

30. A safety binding in accordance with claim 27, wherein said plate has an upper surface which comprises means for facilitating sliding of at least one boot sole thereon.

31. A safety binding in accordance with claim 27, wherein said plate includes spaced support zones adjacent respective front bindings, said plate having a first thickness at each of said support zones, said plate further comprising a recessed central zone between said two support zones, said central zone having a thickness less than the thickness of each of said support zones.

32. A safety binding in accordance with claim 31, wherein said plate tapers downwardly from each said support zone towards said central zone in a substantially continuous fashion.

33. A safety binding in accordance with claim 32, wherein each of said support zones has a substantially convex upper surface.

34. A safety binding in accordance with claim 32, wherein each of said support zones has a substantially flat upper surface.

35. A safety binding in accordance with claim 26, wherein only a central zone of said plate is adapted to contact said monoski, the plate further comprising support zones on either side of the central zone, each of said support zones being spaced upwardly from said upper monoski surface.

36. A safety binding in accordance with claim 35, wherein said support zones comprise flanges extending outwardly from said central zone, said flanges being adapted to rest on the upper surfaces of respective spaced footrest wedges which are located on the upper surface of a monoski to which said plate is adapted to be attached.

37. A safety ski binding in accordance with claim 26, wherein said plate includes a central zone and two lateral zones on opposite sides of said plate, said central zone and said two lateral zones being adapted to contact said monoski when positioned thereon, wherein said plate has a front edge and a rear edge, with two spaced recesses extending from said front edge of said plate, which spaced recesses are adapted to receive two spaced footrest wedges located on the upper surface of a monoski.

38. A safety ski binding in accordance with claim 26, wherein said plate is a unitary member which is adapted to be positioned rearwardly of said front end binding means, said binding further comprising spaced apart foot-rest wedges adapted to be positioned between said front end bindings and said plate.

39. A safety ski binding in accordance with claim 38, wherein said plate has a greater thickness than the thickness of either of said wedges.

40. A safety ski binding in accordance with claim 26, wherein said plate comprises two members which are adjustably positioned with respect to each other transversely of a monoski on which they are adapted to be positioned.

41. A safety ski binding in accordance with claim 40, wherein each member has a transversely extending tongue in slidable abutment with the other member, each member having an upper surface, said upper surfaces of said members being adapted to be at least partially continuous in all positions of said tongues.

42. A safety ski binding in accordance with claim 41, wherein each member further comprises a lower extension, said tongues and said lower extensions having thicknesses which are less than the thicknesses of the remaining portions of each member, each of said tongues being adapted to slide over a respective extension on the other member.

43. A safety ski binding in accordance with claim 41, wherein each front end binding means comprises means for permitting interior motion of a boot held therein.

44. A safety ski binding which is adapted to be used with a monoski having a predetermined width a predetermined length, and an upper surface , said safety binding comprising:

(a) binding means comprising two spaced apart front bindings for releasably supporting the front ends of two boots which are adapted to be positioned on said monoski.

(b) bindings means for releasably supporting the rear portions of two boots which are adapted to be positioned on said monoski:

(c) at least one footrest plate adapted to be positioned on an upper surface of said monoski, said footrest plate having a predetermined width and a predetermined lengths, wherein said plate is adapted to be positioned transversely to the longitudinal extent of said monoski in a position adjacent to said binding means for releasably supporting said boot front ends: and (d) at least one central wedge which is adapted to be positioned on said upper monoski surface and between said front end binding means, said at least one central wedge having a maximum width which is substantially equal to the spacing between two boots positioned on said monoski for normal skiing.

45. A safety ski binding in accordance with claim 44, wherein each wedge is mounted on an arm pivotably mounted to said monoski about an axis located forwardly of said plate.

46. A safety ski binding in accordance with claim 45, further comprising an elastic return mechanism including a spring adapted to return each said arm to a substantially longitudinal position on said monoski after said arm has been displaced from said longitudinal position.

47. A safety ski binding in accordance with claim 45, further comprising two identical wedges mounted directly adjacent to a central longitudinal plane of said monoski 48. A safety ski binding in accordance with claim 44, wherein said wedge is mounted on an arm pivotably mounted to said upper monoski surface about an axis located rearwardly of said plate.

49. A safety ski binding in accordance with claim 48 further comprising two identical wedges mounted directly adjacent to a central longitudinal plane of said monoski.

50. A monoski in accordance with claim 44, wherein said central wedge includes means for adjusting the height of said wedge, wherein said wedge includes a lower wedge section and an upper wedge section adjustably attached to each other, each wedge section having a central bore and a set screw positioned in each of said bores which is adjustable and which thereby comprises means for adjusting the height of said central wedge.

51. A safety ski binding in accordance with claim 18 in combination with a monoski.

52. A safety binding for two ski boots which are adapted to be positioned on a monoski said monoski having a predetermined length and width, said safety binding comprising means for retaining a front end of each of said boots along at least the outside and the top of said monoski, means for laterally releasing each of said boot front ends when excessive force is applied by one of said boots to said retaining means, and means for retaining the rear ends of said respective boots which includes means for freeing said rear ends when excessive force is applied to said boots, said safety binding further comprising a dingle, continuous footrest plate comprising an antifriction material and adapted to be positioned substantially transversely to said length of said monoski and beneath each of said boot front ends and adapted to be attached to an upper surface of said monoski, wherein said means for laterally releasing each of boot front ends when excessive force is applied by one of said boots to said retaining means releases said two boots for movement relative to each other.

53. A safety binding in accordance with claim 18, wherein said force transferring means comprises means for transferring said force of a second, lesser magnitude against the interior side of one of said two boots after said front end of said other of two boots has shifted toward the exterior of said monoski away from said force transferring means.

* * * * *

UNITED STATES PATENT AND TRADEMARK OFFICE

CERTIFICATE OF CORRECTION

PATENT NO. : 4,869,524

DATED : September 26, 1989

INVENTOR(S) : Jean M. BOUQUE

It is certified that error appears in the above-identified patent and that said Letters Patent is hereby corrected as shown below:

At column 1, line 41, change "polytetrafluorethylene" to —polytetrafluoroethylene—.

At column 8, lines 8 and 9, change "polytetrafluorethylene" to —polytetrafluoroethylene—.

At column 8, line 63, change "complimentary" to —complementary—.

At column 12, line 54, change "e.g." to —, e.g.,—.

At column 13, line 31, change "Pf" to —of—.

At column 13, line 50 (claim 1, line 11), insert —,— after "boots".

At column 14, line 26 (claim 7, line 2), insert —,— before "said".

At column 14, line 27 (claim 7, line 3), insert —,— after "width".

At column 14, line 32 (claim 7, line 8), insert —,— before "and".

At column 14, line 36 (claim 7, line 12), insert —,— after "single".

At column 14, line 42 (claim 7, line 18), insert —,— after "monoski".

At column 14, line 44 (claim 7, line 20), insert —,— after "means".

At column 14, line 47 (claim 7, line 23), change "direction ," to —direction,—.

At column 15, line 34 (claim 17, line 2), insert —,— before "said".

At column 15, line 38 (claim 17, line 6), insert —,— after "monoski".

At column 15, line 43 (claim 17, line 11), insert —,— after "boots".

UNITED STATES PATENT AND TRADEMARK OFFICE

CERTIFICATE OF CORRECTION

PATENT NO. : 4,869,524

DATED : September 26, 1989

INVENTOR(S) : Jean M. BOUQUE

It is certified that error appears in the above-identified patent and that said Letters Patent is hereby corrected as shown below:

At column 15, line 44 (claim 17, line 12), insert ——,—— after "single".

At column 15, line 60 (claim 18, line 10), delete "and".

At column 15, line 66 (claim 18, line 16), change "ends." to ——ends; and——.

At column 16, line 44 (claim 28, line 3), delete "," after ".".

At column 17, line 55 (claim 44, line 2), insert ——,—— after "width".

At column 17, line 61 (claim 44, line 8), change "." to ——;——.

At column 17, line 64 (claim 44, line 11), change ":" to ——;——.

At column 17, line 68 (claim 44, line 15), change "lengths" to ——length——.

At column 18, line 4 (claim 44, line 19), change ":" to ——;—— after "ends".

UNITED STATES PATENT AND TRADEMARK OFFICE

CERTIFICATE OF CORRECTION

PATENT NO. : 4,869,524

DATED : September 26, 1989

INVENTOR(S) : Jean M. BOUGUE

It is certified that error appears in the above-identified patent and that said Letters Patent is hereby corrected as shown below:

At column 18, line 24 (claim 47, line 4), insert ——.—— after "monoski".

At column 18, line 43 (claim 52, line 2), insert ——,—— before "said".

At column 18, line 53 (claim 52, line 12), change "dingle" to ——single——.

Signed and Sealed this

Nineteenth Day of November, 1991

*Attest:*

HARRY F. MANBECK, JR.

*Attesting Officer*

*Commissioner of Patents and Trademarks*